US007318739B2

(12) United States Patent
Abe

(10) Patent No.: US 7,318,739 B2
(45) Date of Patent: Jan. 15, 2008

(54) CONNECTOR

(75) Inventor: Kimihiro Abe, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/043,110

(22) Filed: Jan. 14, 2002

(65) Prior Publication Data

US 2003/0114037 A1 Jun. 19, 2003

(30) Foreign Application Priority Data

Jan. 15, 2001 (JP) ..... P2001-006448

(51) Int. Cl.
*H01R 13/627* (2006.01)

(52) U.S. Cl. ..... 439/350

(58) Field of Classification Search ..... 439/350–358
See application file for complete search history.

(56) References Cited

U.S. PATENT DOCUMENTS 5,338,219 A * 8/1994 Hiramoto et al. ..... 439/350
5,348,493 A * 9/1994 Power ..... 439/350
5,380,217 A * 1/1995 Yagi et al. ..... 439/350
5,554,042 A * 9/1996 Denninger ..... 439/272
6,050,838 A * 4/2000 Norizuki et al. ..... 439/310
6,095,844 A * 8/2000 Kasai ..... 439/350
6,171,130 B1 * 1/2001 Yoshida et al. ..... 439/350
7,056,142 B2 * 6/2006 Ueda ..... 439/358

FOREIGN PATENT DOCUMENTS

JP 2-65078 3/1990

* cited by examiner

*Primary Examiner*—Gary F. Paumen
(74) *Attorney, Agent, or Firm*—Sughrue Mion, PLLC

(57) ABSTRACT

A lock projection (12) is formed on a wall portion (6) of one connector (2), and a lock receiving portion (30) for the lock projection (12) is provided at an elastic wall portion (20) of the other connector (3). The connectors (2, 3) are locked together by engaging the lock projection (12) with the lock receiving portion (30). Cancellation convex portions (25) are formed on an inner surface of the elastic wall portion (20) of the other connector (3), and the locking of the connectors (2, 3) is canceled according to the principle of leverage in which the cancellation convex portions (25) serve as fulcrums. An operating flange (22) is formed on and extends from a fitting front end of the wall portion (20) of a hood portion (19). The cancellation convex portions (25) are disposed between the lock receiving portion 30 and the operating flange (22).

11 Claims, 6 Drawing Sheets

CONNECTOR

BACKGROUND OF THE INVENTION

This invention relates to a pair of connectors which can be fitted together to electrically connect wire harnesses or the like together, and more particularly to connectors in which the locking thereof and the cancellation of the locking can be effected positively and easily.

Such known related connectors are disclosed in JP-A-2-65078. The connectors 50, shown in FIGS. 8 and 9, comprise the male connector 51, and the mating female connector 52. The male connector 51 comprises a male connector housing 53, and female terminals 64 each having a wire 35 connected thereto, and the female connector 52 comprises a female connector housing 54, and male terminals 63 each having a wire 35 connected thereto.

A lock lever 56 is formed on the male connector 51, and is supported in a cantilever manner through a hinge 57 provided at a fitting front end thereof. A groove 55 is formed near to a free end portion of the lock lever 56, and therefore the lock lever 56 can be moved upward and downward. A retaining projection 58 of a triangular shape is formed on an upper surface of this lock lever 56 at the support end thereof, and an operating portion 59 is formed on the upper surface of this lock lever at the free end thereof.

On the other hand, the female connector 52 includes a hood 60 having a fitting space for the male connector 51. A groove portion 61, into which the lock lever 56 can move, is formed in the hood 60, and a recess 62, in which the retaining projection 58 of the lock lever 56, is engageable, is formed at an inner end of the groove portion 61.

When the male connector 51 and the female connector 52 are fitted together, the lock lever 56 is inserted into the groove portion 61 in a downwardly-flexed condition, and when the lock lever is further inserted deeper, the retaining projection 58 becomes engaged in the recess 62. At this time, the lock lever 56 is elastically restored from the flexed condition into its original condition to be disposed in a locked condition.

Next, for canceling the locked condition, the lock lever 56 is pressed down, so that the retaining projection 58 is disengaged from the recess 62. Since the groove 55 is formed below the lock lever 56, the lock lever can be flexed. By pulling the connectors 51 and 52 relative to each other in a locking-cancelled condition, the connectors 51 and 52 can be disengaged from each other.

In the above prior technique, however, there were fears that the elastic lock lever 56, when interfered with the exterior, was damaged, and that the operating portion of the lock lever 56, when interfered with the exterior, was flexed downwardly, so that the locking was cancelled, and the male connector 51 and the female connector 52 were accidentally disengaged from each other. These occur because the lock lever 56 protrudes outwardly from the peripheral wall of the male connector 51 and because the large flexure space exists below the lock lever 56 so that the lock lever can be easily flexed upon interference with the exterior.

Similarly, the wall portion of the female connector 52, having the groove portion 61 into which the lock lever 56 can be inserted, protrudes outwardly, and there was a fear that this wall portion, when interfered with the exterior, was crushed, so that the recess 62 was deformed, and the locking could not be canceled, and the pair of connectors 50 could not be disengaged from each other.

And besides, in this kind of connectors 50, the narrow, elongate, cantilever-like lock lever 56 is integrally formed, and therefore the quality is influenced by the flowability of a molten resin, and the removal of the molded product from a mold and so on were difficult, and there were fears of variations in molding precision, the incomplete molding and so on because of the complicated structure.

Furthermore, there is a tendency for a wire harness, often installed in a narrow space within an instrument panel or the like, to be formed into a narrow design so as not to interfere with electrical equipments and the like, and therefore connectors, attached to ends of the wire harness, have also been required to have a compact design. In the related connectors 50, however, the lock structure, including the lock lever 56 and so on, protrudes outwardly from the connectors 50, and it has been difficult to meet the requirement for the compact design of the connectors.

SUMMARY OF THE INVENTION

With the foregoing in view, it is an object of this invention to provide a lock mechanism and a lock-canceling mechanism for compact connectors which can easily and positively effect the locking of the pair of connectors and the cancellation of the locking. Another object is to facilitate the resin-molding and to effect the molding at a low cost.

In order to solve the aforesaid object, the invention is characterized by having the following arrangement.

(1) A connector comprising:

a first connector including a lock projection formed on a wall portion of the first connector; and a second connector which is electrically connectable to the first connector and includes a lock receiving portion provided at an elastic wall portion of the second connector, wherein the first and second connector are locked together by engaging the lock projection with the lock receiving portion.

(2) The connector according to (1), wherein a cancellation convex portion is formed on an inner surface of the elastic wall portion of the second connector, and the locking of the first and second connectors is canceled according to the principle of leverage in which the cancellation convex portion serves as a fulcrum.

(3) The connector according to (2), wherein the first connector is a male connector and the second connector is a female connector, and the lock receiving portion and the cancellation convex portion are formed at the elastic wall portion of a fitting hood of the second connector.

(4) The connector according to (2), wherein the first connector is a female connector and the second connector is a male connector, and the lock projection is formed on the elastic wall portion of a fitting hood of the female connector.

(5) The connector according to (3) or (4), wherein an operating flange is formed and extends from the elastic wall portion of the hood portion toward a fitting front side, and a flexing allowance is formed between the operating flange and the upper wall portion of the male connector.

(6) The connector according to (4) or (5), wherein the cancellation convex portion is disposed between the lock receiving portion and the operating flange.

(7) The connector according to (3) through (6), wherein ribs which are smaller in height than the lock projection are formed at and project from opposite sides of wall portion of one of first and second connectors, respectively, and a flexure space for operation of the rib is formed between the ribs.

The operation and effects, based on the above construction, will be described below.

According to the present invention, the one connector is inserted into a fitting space in the other connector, and is further inserted deeper, so that the lock projection is engaged in a lock hole, thereby locking the two connectors together.

According to the principle of leverage, the cancellation convex portion, formed on the other connector, serves as a fulcrum while the open end portion of the other connector serves as a point of application, so that portion of the wall portion, disposed remote from the point of application, can be lifted, and therefore the engagement between the lock projection and the lock receiving portion can be canceled.

When the male connector, having the lock projection formed thereon, is fitted into the fitting space in the female connector, the open end of the male connector first abuts against the cancellation convex portion of the female connector, and when the male connector is further inserted, the lock projection on the male connector abuts against the open end portion of the female connector, and when the male connector is further slid and inserted deeper, the lock projection is engaged with the lock receiving portion, thereby achieving the locking. For canceling the locking, the open end portion of the fitting hood is used as a point of application, and that portion of the wall portion, disposed remote from the point of application, is lifted according to the principle of leverage, thereby canceling the locking.

When the male connector is inserted into the fitting space in the female connector, the open end of the male connector abuts against the cancellation convex portion of the female connector, and when the male connector is further inserted, the open end of the male connector abuts against the lock projection of the female connector, and when the male connector is further slid and inserted deeper, the lock projection is engaged with the lock receiving portion, thereby achieving the locking. For canceling the locking, the wall portion of the hood portion is pressed according to the principle of leverage.

The operating flange is formed at the open end of the fitting hood, and therefore when the operating flange is flexed, the engagement between the lock projection and the lock receiving portion can be easily canceled according to the principle of leverage. And besides, since the flexing allowance is formed between the operating flange and the wall portion, the operating flange can be easily flexed.

The cancellation convex portion is disposed between the lock receiving portion and the operating flange, and therefore there can be utilized the principle of leverage in which the cancellation convex portion serves as a fulcrum. In the case where a plurality of such cancellation convex portions are provided in parallel, spaced relation, there are provided a plurality of fulcrums supporting the pressing force acting on the point of application, and therefore the force is distributed, thereby preventing the deformation (such as crush) of the cancellation convex portions.

The flexure space is formed between the ribs formed respectively at the right and left ends of the wall portion of the male or the female connector, and therefore the locking can be cancelled by depressing the operating flange.

BRIEF DESCRIPTION OF THE DRAWINGS

FIGS. 6A-6B2 are views explanatory of the condition of use of the connectors shown in FIG. 1; FIG. 6A is a view showing a locked condition, and FIGS. 6B1 and 6B2 are views showing a lock-canceling operation.

DETAILED DESCRIPTION OF PREFERRED EMBODIMENTS

A preferred embodiment of the present invention will now be described in detail with reference to the drawings.

Figure 1:
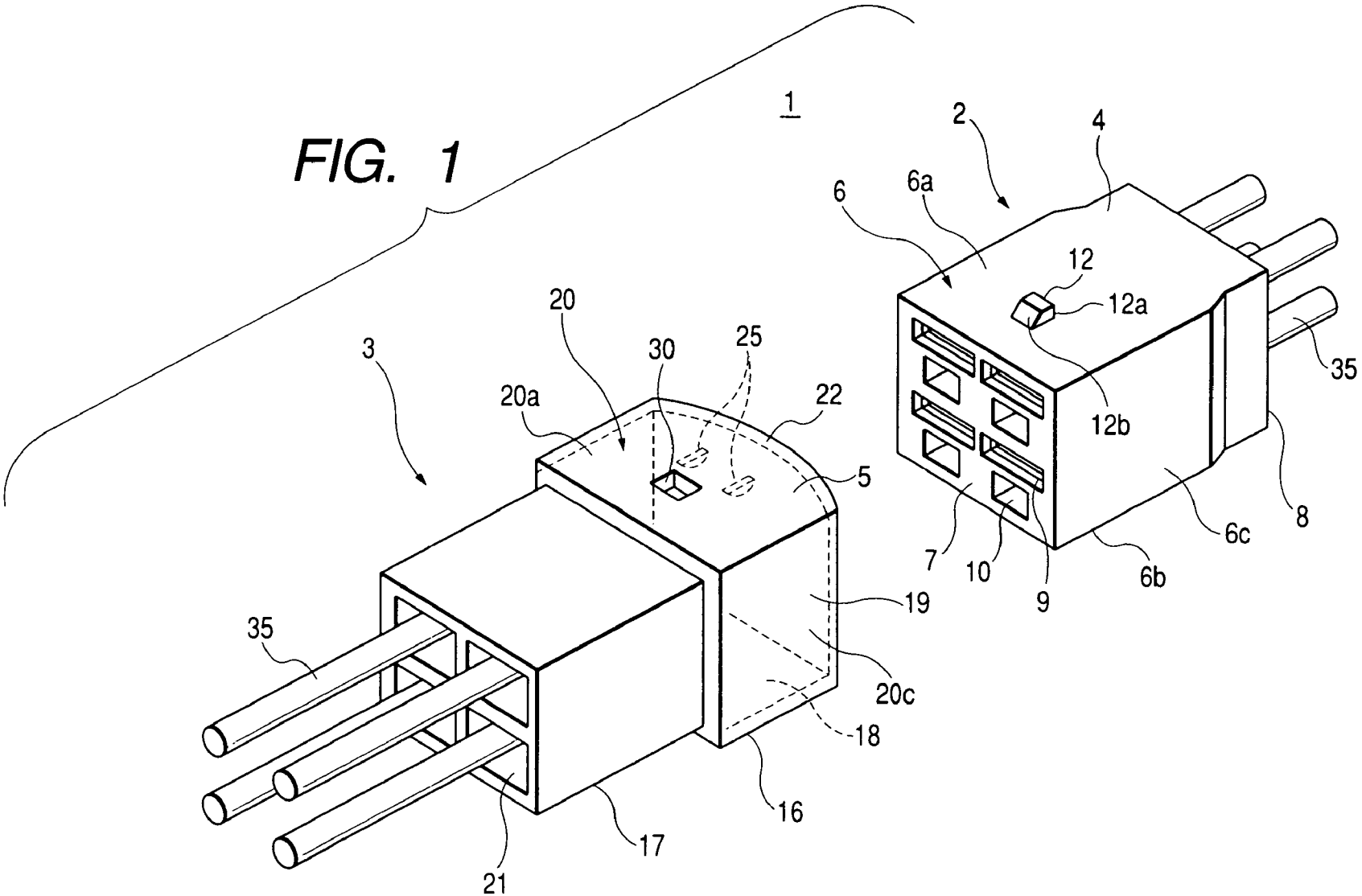
FIG. 1 is an exploded, perspective view showing a first embodiment of connectors of the present invention.
Figure 2:
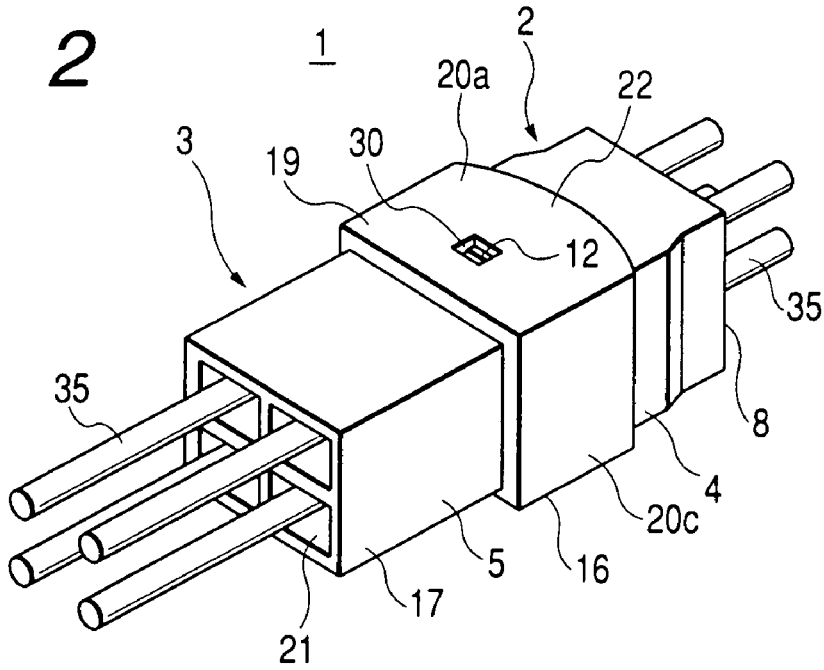
FIG. 2 is a view showing the connectors of FIG. 1 in an assembled condition.
Figure 3:
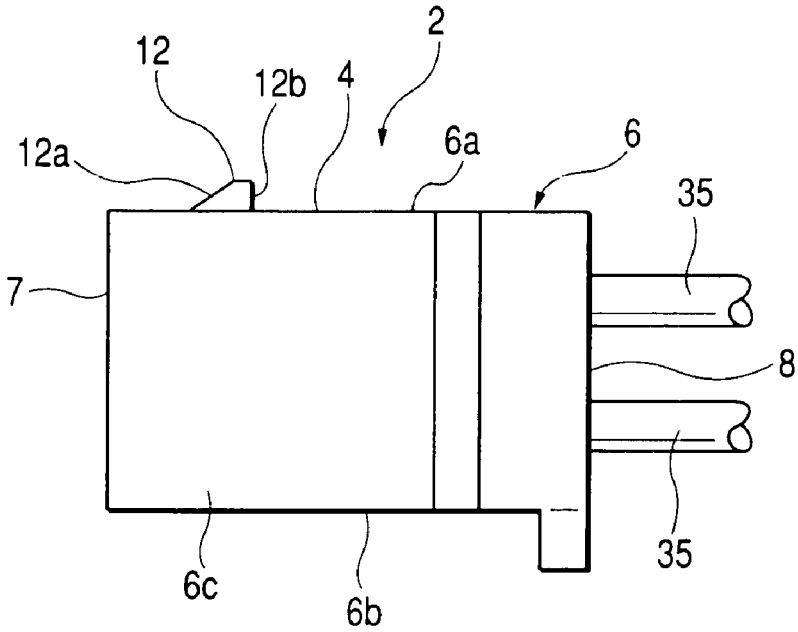
FIG. 3 is a side-elevational view of the male connector shown in FIG. 1.
Figure 4:
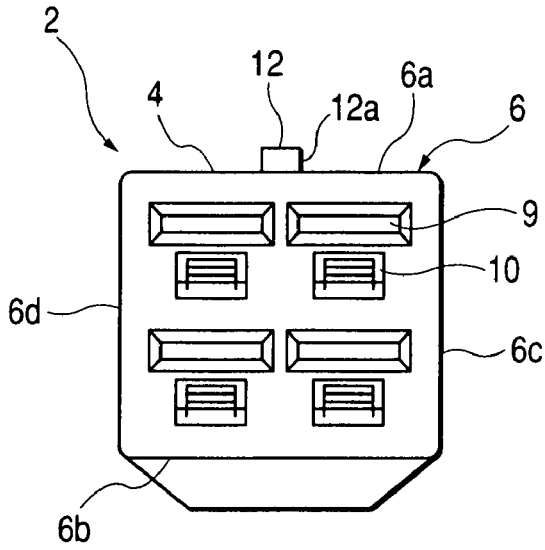
FIG. 4 is a front-elevational view of the male connector shown in FIG. 1.
Figure 5:
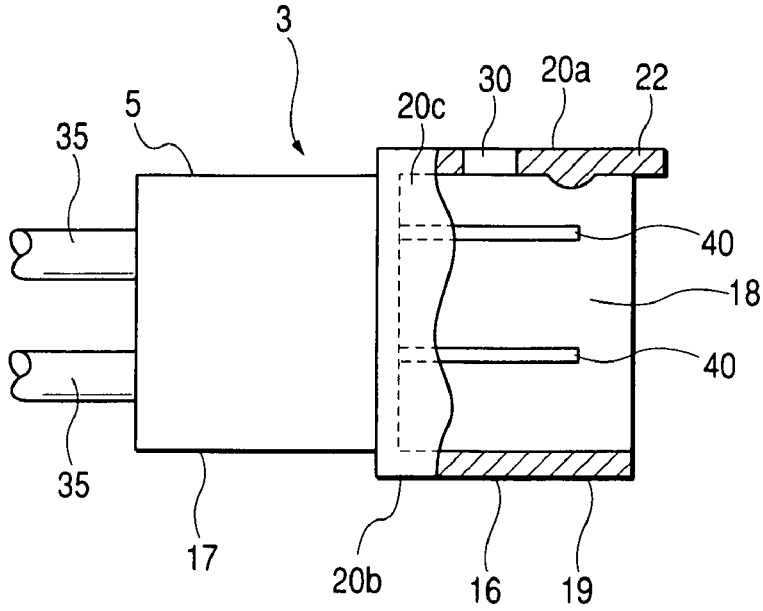
FIG. 5 is a partly-cross-sectional, side-elevational view of the female connector shown in FIG. 1.
Figure 6A:
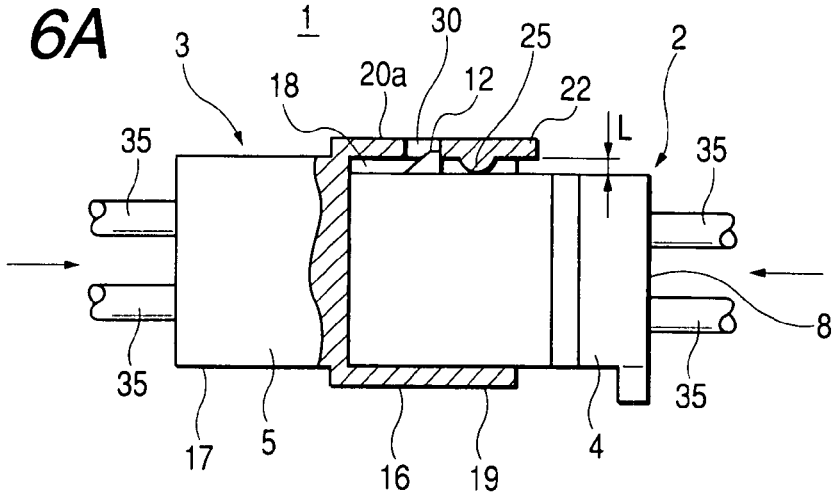
Figure 6A:
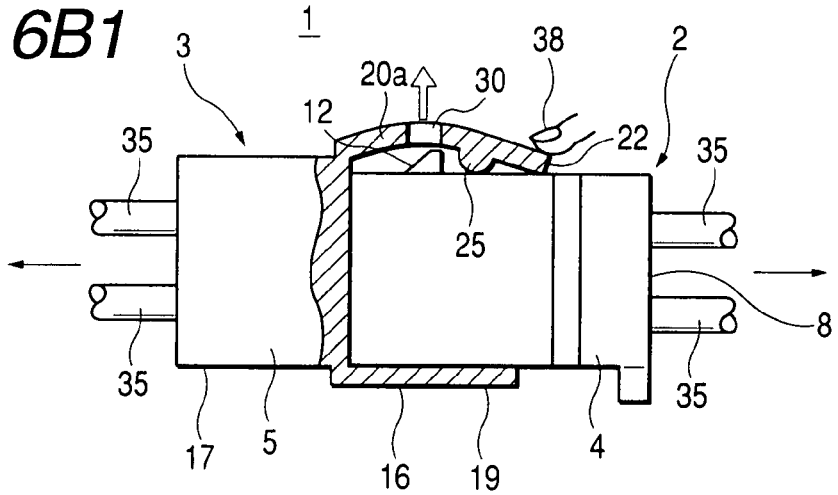
Figure 6A:
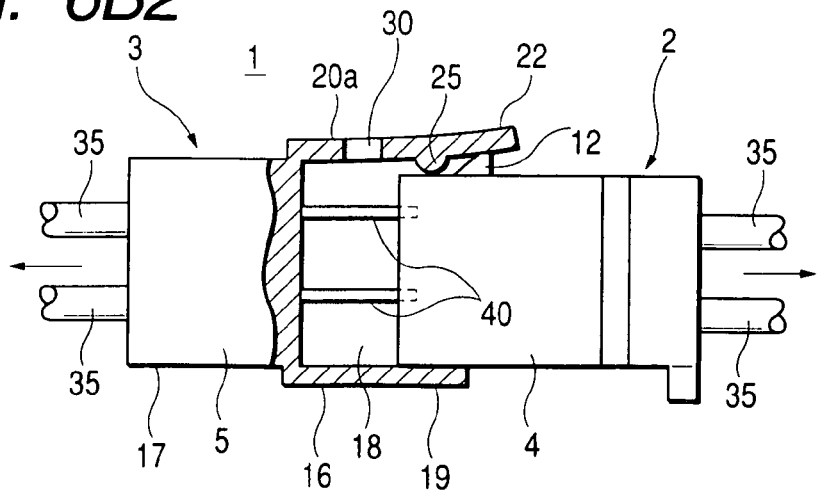

FIGS. 1 to 6 show a first embodiment of connectors of this invention. FIG. 1 is an exploded, perspective view showing the first embodiment of the connectors of the invention, FIG. 2 is a view showing the connectors of FIG. 1 in an assembled condition, FIG. 3 is a side-elevational view of the male connector shown in FIG. 1, FIG. 4 is a front-elevational view of the male connector shown in FIG. 1, FIG. 5 is a partly-cross-sectional, side-elevational view of the female connector shown in FIG. 1, FIG. 6 is a view explanatory of the condition of use of the connectors shown in FIG. 1, and FIG. 6A is a view showing a locked condition, and FIGS. 6B1 and 6B2 are views showing a lock-canceling operation.

As shown in FIGS. 1 and 2, the pair of connectors 1 comprises the male connector 2, and the female connector 3, and the male connector 2 comprises a male connector housing 4, and female terminals (not shown) each having a wire 35 connected thereto, and the female connector 3 comprises a female connector housing 5, and male terminals (not shown) each having a wire connected thereto.

The male connector housing 4 is formed into a square pillar-shape defined by upper and lower walls 6*a* and 6*b*, side walls 6*c* and 6*d* and front and rear walls 7 and 8 facing respectively in forward and rearward directions. Here, the term "forward-rearward direction" should be construed as usual, and that side, which can be fitted relative to the mating connector, is the front side. With respect to the upward-downward direction (direction of the height), the upper and lower sides are as shown on the sheets of the drawings for convenience' sake.

Terminal receiving chambers 9, separated from one another, are formed within the male connector housing 4, and the four female terminals, each having the wire 35 connected thereto, are adapted to be received in these chambers, respectively. Open ends of the terminal receiving chambers 9 are formed in the front and rear walls 7 and 8. Openings, disposed respectively below the openings of the terminal receiving chambers 9 formed in the front wall 7, are insertion holes 10, respectively, each for allowing a terminal-with drawing jig (not shown) to be inserted thereinto.

As shown in FIGS. 3 and 4, a lock projection 12 for engagement with the mating female connector housing 5 to retain the male connector housing against withdrawal is formed on the upper wall 6*a* (wall portion 6), and this lock projection is disposed generally at the middle of the upper wall in the right-left direction (widthwise direction), and is disposed slightly forwardly of the middle thereof in the forward-rearward direction (longitudinal direction).

The lock projection 12 is molded into a mountain-like cross-sectional shape. A front surface 12*b* of the lock projection 12 is slanting gently, and is so formed as to reduce an insertion force produced when fitting the pair of connectors 1 together. On the other hand, a rear surface 12*a* at the opposite side is a vertical surface, and can be retainingly engaged in a lock hole (lock receiving portion) 30 (described later) in the female connector housing 5.

As shown in FIG. 5, the female connector housing 5 includes a front half portion 16, having a fitting space 18 for the male connector housing 4, and a rear half portion 17 which extends rearwardly from the front half portion 16, and has terminal receiving chambers 21 for respectively receiving the male terminals 40.

A fitting hood 19 is formed at the front half portion 16 so that the male connector housing 4 can be inserted into the fitting space 18, the fitting hood being formed by an elastic wall portion 20. The lock hole 30 (lock receiving portion) is formed through that portion of an upper wall 20*a* (wall portion 20) of this fitting hood 19 corresponding to the lock projection 12. This lock hole 30 is formed such that a small clearance is formed between this lock hole and the lock projection 12, and therefore the engagement can be effected smoothly while absorbing a molding error.

An operating flange 22 is formed on the upper wall 20*a* of the fitting hood 19 at an open end thereof, and extends forwardly from the fitting front end thereof. As shown in FIG. 1, this operating flange 22 projects forwardly gradually from its opposite ends (in the widthwise direction) toward a central portion thereof, so that the central portion defines a foremost end portion. The operating flange 22 serves to assist the upper wall 20*a* in being elastically deformed when canceling the locking as described later.

Cancellation convex portions 25 for canceling the engagement between the lock projection 12 and the lock hole 30 are formed on an inner surface of the upper wall 20*a* of the fitting hood 19. The cancellation convex portions 25 are formed between the lock hole 30 and the operating flange 22. This arrangement is provided for the purpose of canceling the engagement, utilizing the well-known principle of a lever. More specifically, when the operating flange 22 is pressed down, with the cancellation convex portions 25 used as fulcrums, the lock hole 30 is moved upward, thereby canceling the engagement.

A flexing allowance L is formed between the operating flange 22 and the upper wall 6*a* of the male connector housing 4. The amount of the flexing allowance L is arbitrary, but is set to an amount which can allow the cancellation of the engagement. As in a second embodiment of the present invention (FIG. 7) described later, ribs 15 may be formed respectively at opposite (right and left) ends of the upper wall 6*a* of the male connector housing 4 to provide a flexure space 14.

In this embodiment, although the cancellation convex portions 25 are provided respectively at two regions in parallel, spaced relation to each other, it maybe provided at one region, or these may be provided respectively at more than two regions in parallel, spaced relation to one another. In the case where these are provided at the plurality of regions, there are provided a plurality of fulcrums, and the pressing force is distributed, and advantageously this prevents the deformation (such as crush) of the cancellation convex portions 25.

FIG. 6A shows the connectors 1 in the locked condition, and FIGS. 6B and 6C show the lock-canceling operation.

For locking the connector 1 as shown in FIG. 6A, first, the male connector 2, having the lock projection 12 formed thereon, is inserted into the female connector 3 having the fitting space 18. As a result, the open end of the male connector 2 abuts against the cancellation convex portions 25 of the female connector 3. When the male connector is further inserted, the lock projection 12 on the male connector 2 abuts against the open end of the female connector 3. When the male connector is further inserted and slid deeper, the lock projection 12 becomes engaged in the lock hole 30 to be locked thereto.

The cancellation convex portions 25 are formed on and project from the inner surface of the upper wall 20*a* of the fitting hood 19, and therefore will not protrude outwardly, and are prevented from interfering with other parts. The receiving portion for the lock projection 12 may be a through hole as in this embodiment, or may be a blind hole or a recess.

Next, for canceling the locking of the connectors 1, this is effected by depressing the operating flange 22 of the female connector 3 by the finger 38. According to the principle of leverage, the cancellation convex portions 25 serve as fulcrums while the operating flange 22 serves as a point of application on which the pressing force acts, and therefore that portion of the upper wall 20*a*, disposed remote from the point of application, can be lifted, and therefore the engagement between the lock projection 12 and the lock hole 30 can be canceled.

In this embodiment, although the lock projection 12 is formed on the male connector 2 while the lock hole 30 and the cancellation convex portions 25 are formed at the female connector 3, the lock hole 30 or a recess may be formed in the male connector 2 while the lock projection 12 and the cancellation convex portions 25 may be formed on the female connector 3.

In this embodiment, although the lock projection 12, the lock hole 30 and the cancellation convex portions 25 are all formed at the upper walls 6*a* and 20*a* of the connectors 2 and 3, these may be formed at the lower walls 6*b* and 20*b*, or may be formed at the side walls 6*c*, 6*d*, 20*c* and 20*d*.

Figure 7:
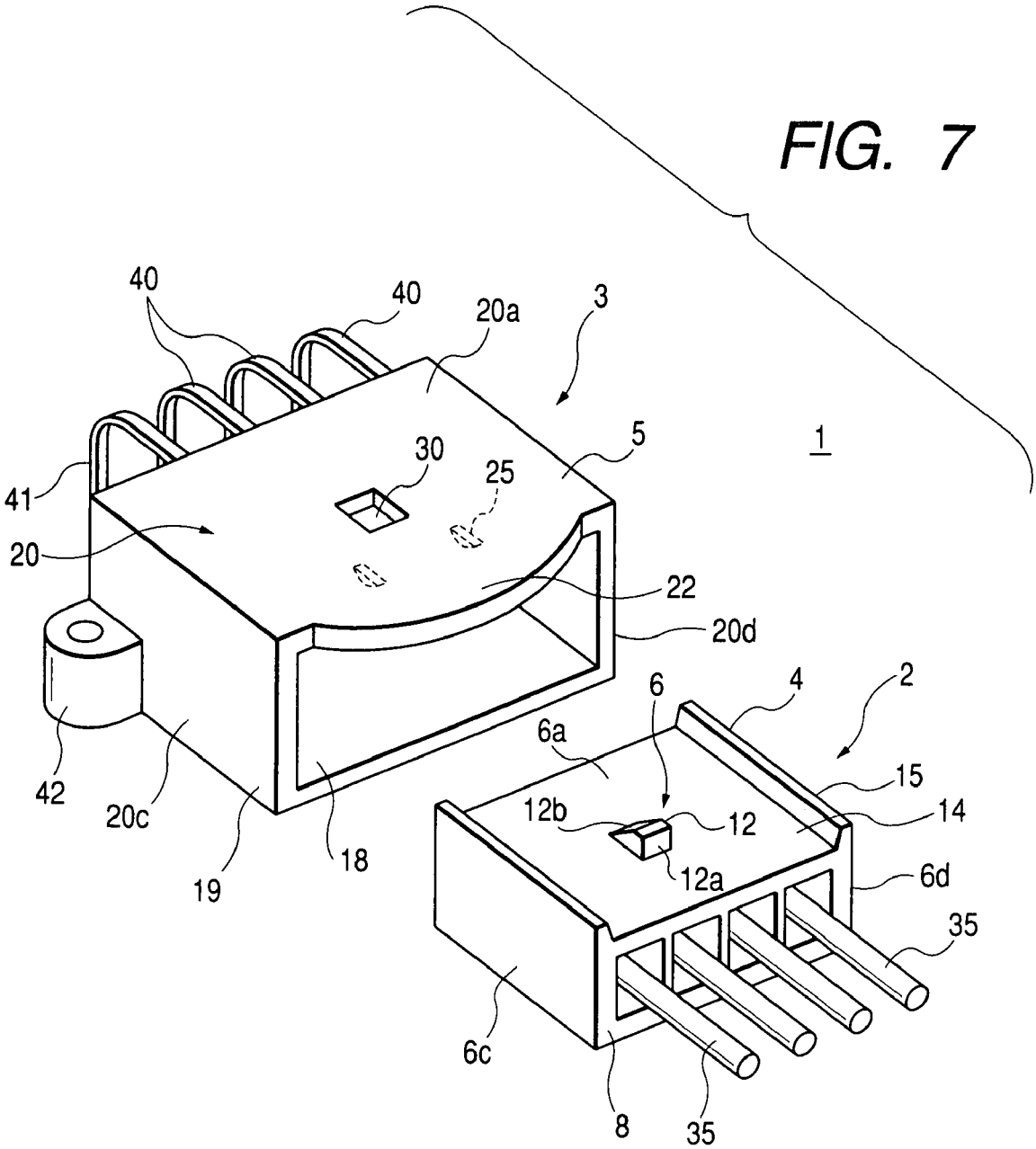
FIG. 7 is an exploded, perspective view showing a second embodiment of connectors of the invention.
Figure 8:
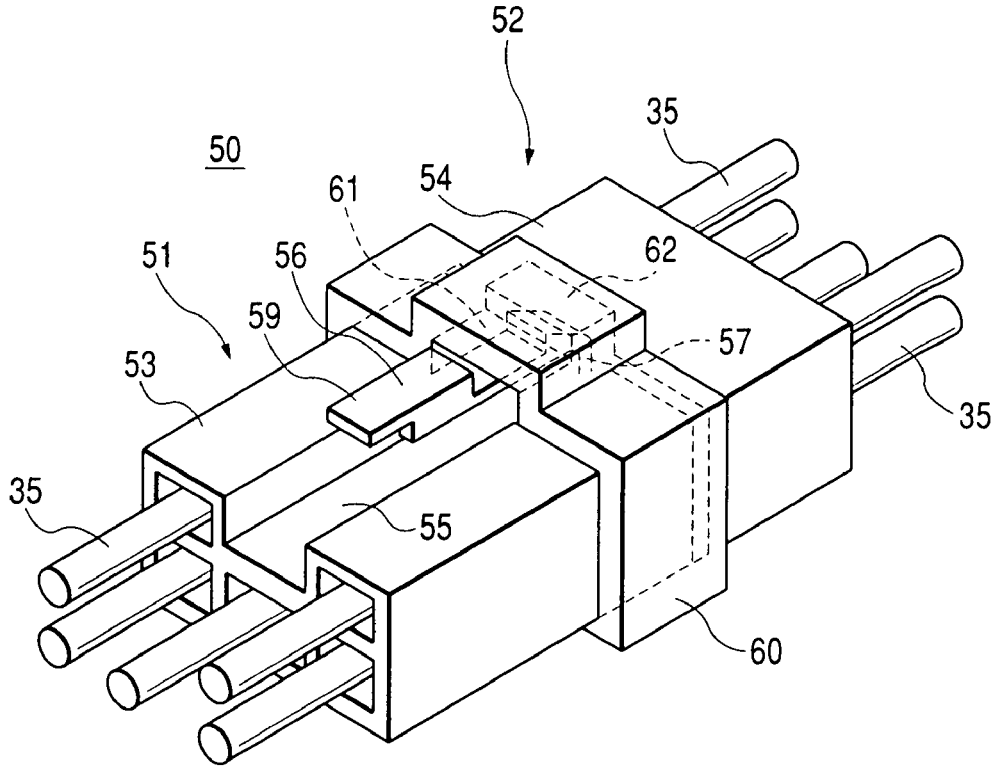
FIG. 8 is a cross-sectional view showing one example of related connectors.
Figure 9:
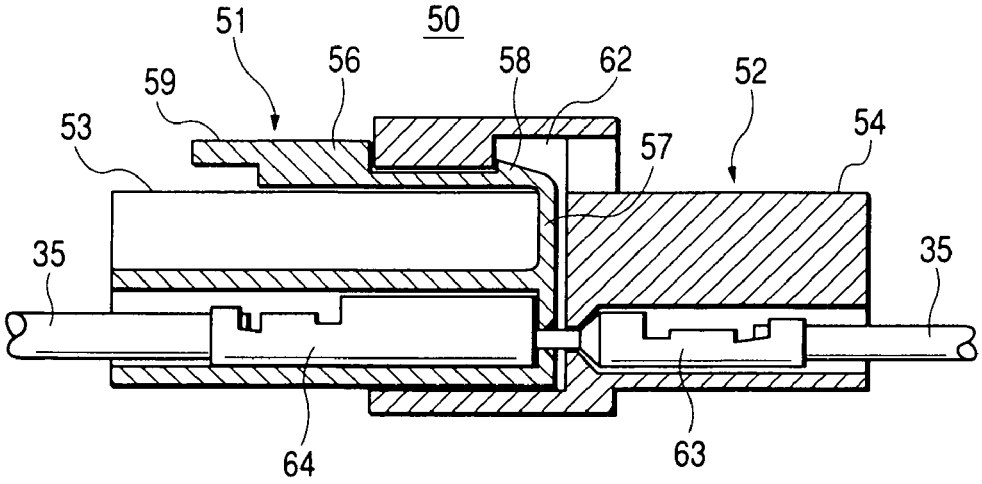
FIG. 9 is a sectional view showing the related connector shown in FIG. 8.

Next, the second embodiment of the connectors of the present invention, shown in FIG. 7, will be described. The connectors of this embodiment differ from the first embodiment in that ribs 15 are formed respectively at opposite (right and left) ends of an upper wall 6*a* of a male connector housing 4. Namely, in the above first embodiment, the upper wall 6*a* is formed into a flat configuration, and in this embodiment the upper wall 6*a* is formed into a recessed condition because of the provision of the right and left ribs 15.

The connectors 1 are the connectors 1 of the board-directly-mounting type which are adapted to be attached to a printed circuit board (not shown) or the like, and have male terminals 40 whose leg portions 41 are adapted to be connected to wiring patterns on the board.

The male connector 2 comprises the male connector housing 4, and female terminals (not shown) each having a wire. The female connector 3 comprises a female connector housing 5 having a fitting space 18, and the male terminals 40 bent generally at right angles. A bracket 42 for fixedly securing the connectors 1 to the printed circuit board is formed on and projects from a side wall 20*c* of the female connector 3.

The leg portions 41 of the male terminals 40 project from a rear wall, and distal ends of the leg portions 41 are inserted respectively in connection holes (not shown), formed through the printed circuit board, and are electrically connected to the wiring patterns connected to the connection holes.

As described above, the ribs 15 are formed on and extend along the right and left ends or edges of the upper wall 6*a* of the male connector 2, respectively. The ribs 15 are smaller in height than a lock projection 12, and therefore when the two connectors 2 and 3 are locked together, there is provided a dimension of retaining engagement between the lock projection 12 and a lock hole 30, and therefore the connectors 1 will not be disengaged from each other.

For canceling the locking of the two connectors 2 and 3, an operating flange 22 is depressed, thereby canceling the engagement between the lock projection 12 and the lock hole 30. A flexure space 14 for allowing the depression of the operating flange 22 is formed between the right and left ribs 15.

The ribs 15 may be formed not on the upper wall 6*a* of the male connector housing 4 but on an inner surface of an upper wall 20*a* of a fitting hood 19 of the female connector housing 5.

As described above, according to the invention, the pair of connectors can be easily locked together by engaging the lock projection with the lock receiving portion. Therefore, the locking can be positively effected with the simple construction, that is, without providing any outwardly-protruding portion, and this is effective for the compact connector. And besides, the molding cost is not increased, and the molding can be effected at a low cost.

The locking of the connectors can be easily canceled according to the principle of leverage in which the cancellation convex portions serve as the fulcrums. And besides, the lock-canceling mechanism is simple in construction, and therefore this is effective for the compact connector.

The locking can be easily canceled according to the principle of leverage in which the cancellation convex portions serve as the fulcrums while the open end portion of the hood portion of the female connector serves as the point of application. Therefore, similar effects, as described above, are achieved.

The operating flange is formed, and therefore the engagement of the lock projection with the lock receiving portion can be easily canceled. And besides, since the flexing allowance is secured below the operating flange, the operability for the locking-canceling operation can be enhanced. Therefore, the effects as described above are achieved.

The cancellation convex portions are disposed between the lock receiving portion and the operating flange, and therefore utilizing the principle of leverage in which the cancellation convex portions serve as the fulcrums while the operating flange serves as the point of application on which the pressing force acts, the lock receiving portion is lifted outwardly, so that the engagement between the lock projection and the lock receiving portion can be easily canceled.

The flexure space is formed between the ribs formed respectively at the right and left ends of the male or the female connector, and therefore the operating flange can be flexed downwardly. Therefore, the locking can be cancelled positively.

What is claimed is:

1. A connector comprising:

a first connector including a lock projection formed on a wall portion of the first connecton; and a second connector which is electrically connectable to the first connector and includes a lock receiving portion provided at an elastic wall portion of the second connector, wherein:

the first and second connectors are locked together by engaging the lock projection with the lock receiving portion;

a cancellation convex portion is formed on an inner surface of the elastic wall portion of the second connector; and the locking of the first and second connectors is canceled according to the principle of leverage in which the cancellation convex portion serves as a fulcrum about which an operational flange is manually depressed and the lock receiving portion is thus raised.

2. The connector according to claim 1, wherein the first connector is a male connector and the second connector is a female connector, and the lock receiving portion and the cancellation convex portion are formed at the elastic wall portion of a fitting hood of the female connector.

3. The connector according to claim 1, wherein the first connector is a female connector and the second connector is a male connector, and the lock projection is formed on the wall portion of a fitting hood of the female connector.

4. The connector according to claim 2, wherein the operating flange is formed and extends from the elastic wall portion of the hood portion toward a fitting front side, and a flexing allowance is formed between the operating flange and the upper wall portion of the male connector.

5. The connector according to claim 3, wherein the operating flange is formed and extends from the elastic wall portion of the hood portion toward a fitting front side, and a flexing allowance is formed between the operating flange and the upper wall portion of the male connector.

6. The connector according to claim 5, wherein the cancellation convex portion is disposed between the lock receiving portion and the operating flange.

7. The connector according to claim 4, wherein the cancellation convex portion is disposed between the lock receiving portion and the operating flange.

8. The connector according to claim 2, wherein ribs which are smaller in height than the lock projection are formed at and project from opposite sides of wall portion of one of first and second connectors, respectively, and a flexure space for operation of the the operating flange is formed between the ribs.

9. The connector according to claim 3, wherein ribs which are smaller in height than the lock projection are formed at and project from opposite sides of wall portion of one of first and second connectors, respectively, and a flexure space for operation of the operating flange is formed between the ribs.

10. The connector according to claim 1, wherein multiple cancellation convex portions are formed.

11. The connector according to claim 1, wherein said cancellation convex portion comprises a generally half-disc shaped portion protruding from the inner surface of the elastic wall portion of the second connector.

* * * * *